US008365417B2

(12) United States Patent
Bland

(10) Patent No.: US 8,365,417 B2
(45) Date of Patent: Feb. 5, 2013

(54) SCISSORS WITH AN INTEGRATED TAPE DISPENSER

(75) Inventor: Michael Scott Bland, Atlanta, GA (US)

(73) Assignee: Edison Nation, LLC, Charlotte, NC (US)

( * ) Notice: Subject to any disclaimer, the term of this patent is extended or adjusted under 35 U.S.C. 154(b) by 4 days.

(21) Appl. No.: 12/924,744

(22) Filed: Oct. 4, 2010

(65) Prior Publication Data

US 2011/0016725 A1 Jan. 27, 2011

Related U.S. Application Data

(63) Continuation of application No. 11/974,375, filed on Oct. 12, 2007, now Pat. No. 7,805,842.

(51) Int. Cl.
*B26B 13/22* (2006.01)

(52) U.S. Cl. ..... 30/123; 30/232; 30/254; 225/7

(58) Field of Classification Search ..... 30/231, 30/232, 235, 236, 254, 123; 225/7; 7/160; D8/57

See application file for complete search history.

(56) References Cited

U.S. PATENT DOCUMENTS

| | | | | |
|---|---|---|---|---|
| 140,227 | A | 6/1873 | Stubbings | 30/254 |
| 346,583 | A | 8/1886 | Corbett | 30/341 |
| 348,749 | A | 9/1886 | Kimbler | 30/226 |
| 389,553 | A | 9/1888 | Diefendorf | 30/254 |
| 580,995 | A | 4/1897 | Thorlakson | 30/146 |
| 643,377 | A | 2/1900 | Janney | |
| 752,339 | A | 2/1904 | Gutstein | 30/341 |
| D47,735 | S | 8/1915 | Piggott | D8/55 |
| 1,182,561 | A | 5/1916 | Hanscom | 30/146 |
| 1,218,798 | A | 3/1917 | Nelson | 30/254 |
| 1,223,640 | A | 4/1917 | Sweet | |
| 1,276,433 | A | 8/1918 | Stafnbrook et al. | |
| 1,300,932 | A | 4/1919 | Dingle | |
| 1,436,948 | A | 11/1922 | Dedio | |
| 1,935,812 | A | 11/1933 | Moody | 30/143 |
| 2,023,408 | A | 12/1935 | Coll | 30/134 |
| 2,023,409 | A | 12/1935 | Coll | 30/123 |
| 2,136,769 | A | 11/1938 | Witchger | 33/767 |

(Continued)

FOREIGN PATENT DOCUMENTS

| | | | |
|---|---|---|---|
| JP | 02206492 | A | 8/1990 |
| JP | 2000-5464 | A | 1/2000 |

(Continued)

OTHER PUBLICATIONS

International Search Report and Written Opinion, both dated Dec. 24, 2008 issued in international application No. PCT/US2008/008912.

(Continued)

*Primary Examiner* — Jason Daniel Prone

(74) *Attorney, Agent, or Firm* — Tillman Wright, PLLC; Chad D. Tillman; James D. Wright

(57) ABSTRACT

A combined scissors and tape dispenser configured as a unitary construction. The combined scissors and tape dispenser apparatus includes a pair of blades. A first blade includes a first elongated cutting member integrated with a first looped handle portion. A second blade is pivotally connected to the first blade. The second blade includes a second elongated cutting member integrated with a second looped handle portion. A dispenser reel including a cutting implement is integrated as part of at least one of the first looped handle portion and the second looped handle portion. The dispenser reel includes a through-hole adapted to be gripped by at least one of the user's fingers.

14 Claims, 12 Drawing Sheets

U.S. PATENT DOCUMENTS

| | | | | |
|---|---|---|---|---|
| 2,159,060 | A | 5/1939 | Tuttle et al. | 30/254 |
| 4,763,415 | A | 8/1988 | Huang | |
| 4,783,867 | A | 11/1988 | Tsao | |
| 5,539,994 | A | 7/1996 | Milden | 33/760 |
| 6,272,754 | B1 | 8/2001 | Hesprich | |
| 6,273,582 | B1 * | 8/2001 | Taggart et al. | 7/118 |
| 6,286,745 | B1 | 9/2001 | Ackeret | |
| D463,494 | S * | 9/2002 | Mori | D8/105 |
| 6,523,264 | B1 | 2/2003 | Albert et al. | |
| 6,783,042 | B2 | 8/2004 | Kaufer | 7/160 |
| 6,813,976 | B2 | 11/2004 | Malvini et al. | 7/127 |
| 6,874,189 | B2 | 4/2005 | Ackeret | |
| 6,883,238 | B1 | 4/2005 | Tran | |
| D505,054 | S | 5/2005 | McLean et al. | D8/57 |
| 6,941,604 | B2 | 9/2005 | Ackeret | 7/160 |
| D532,269 | S | 11/2006 | Kaye | D8/57 |
| 7,143,922 | B2 | 12/2006 | Shevin-Sandy | |
| 7,373,682 | B2 | 5/2008 | Cetera | 7/160 |
| 7,421,787 | B2 * | 9/2008 | White et al. | 30/123 |
| 7,591,037 | B1 | 9/2009 | Strickland | 7/160 |
| 7,805,842 | B2 * | 10/2010 | Bland | 30/123 |
| 2003/0221320 | A1 | 12/2003 | Carpenter et al. | |
| 2005/0217032 | A1 | 10/2005 | Bruggisser | 7/119 |
| 2007/0124866 | A1 | 6/2007 | Grepper | 7/160 |
| 2009/0172889 | A1 * | 7/2009 | Votolato | 30/337 |
| 2010/0122419 | A1 | 5/2010 | Zupancic-Albin | 7/125 |

FOREIGN PATENT DOCUMENTS

| | | |
|---|---|---|
| KR | 20-0241869 Y1 | 10/2001 |
| WO | PCT/US2008/008912 | 4/2009 |

OTHER PUBLICATIONS

Advertisement for "Easy Glide Gift Wrapping Shears" printed on Feb. 11, 2010 from http://www.qvc.com/qic/qvcaop.aspx/view.2/app.detail/params.aol_refer.false.tpl.detail.msn_refer.false.item.V28091.ref.GBA?cm_ven=GOOGLEBASE&cm_cat=Sports%20&cm_pla=Crafts%20&cm_ite=V28091.

* cited by examiner

SCISSORS WITH AN INTEGRATED TAPE DISPENSER

CROSS REFERENCE TO RELATED APPLICATIONS

This application is a Continuation which claims the benefit of the filing date of U.S. Non-Provisional application Ser. No. 11/974,375, entitled "SCISSORS WITH AN INTEGRATED TAPE DISPENSER" filed Oct. 12, 2007 now U.S. Pat. No. 7,805,842, the entirety of which is incorporated herein by reference.

BACKGROUND OF THE INVENTION

1. Field of the Invention

The invention combines two common household items frequently used in conjunction with each other, as a single autonomous unit. Specifically, the invention combines scissors with a tape dispenser in a way that makes both easily usable as a single device.

2. Description of the Related Art

Almost all household scissors and tape dispensers are designed to perform one single respective function. Currently, scissors cut objects and tape dispensers dispense tape, each with its single unique purpose. Very often, when one uses a pair of scissors, one is in need of a tape dispenser, and vice versa. This is especially evident with the tasks of wrapping gifts, which requires the use of scissors and tape.

One apparent problem is that because each item, namely scissors and a tape dispenser, are separate items, and are frequently used in a variety of instances, when it is time to use the items collectively, they cannot be found in the same location. Quite the contrary occurs, that is, it seems that one can never find the scissors when the tape is found, and vice-versa, the tape cannot be found when the scissors are found.

Another problem that exists is that when using tape and scissors in conjunction with each other, the user cannot simultaneously manipulate both at the same time. The user must put down the pair of scissors each time he or she wants to use the tape dispenser, and vice-versa. This process of switching back and forth is inefficient; especially when wrapping multiple gifts, or any project that requires laborious cutting and taping.

Conventionally, scissors and tape dispensers are stored differently. For example, household scissors and tape are frequently stored out of sight. Scissors are commonly stored in a drawer of a desk, in a cupboard or the like, because they do not "stand alone" and contribute to disorganized clutter when they are placed otherwise. Traditional scissors lie on their side, slide around, and, consequently, are often tossed in a drawer when they are not being used. However, in an office environment, tape may be stored in a receptacle on a desk in plain view. This compounds the issue of scissors and tape not being located in the same place.

Another disadvantage is that most household tape dispensers are designed as disposable products. When one gets to the end of the tape roll, the dispenser is now a useless item and discarded, thereby creating waste.

SUMMARY OF THE INVENTION

An object of the present invention is to provide a unitary construction for an integrated apparatus including scissors and a dispenser.

This invention alleviates the problem of repeatedly switching between using a pair of scissors and a tape dispenser, and vice versa. According to this unitary construction, the tape dispenser may be used to dispense tape while holding the scissors and without having to put the scissors down. This use is compact, more efficient, saves time, and prevents the cumbersome task of having to constantly put down and pick up two different objects, i.e., the scissors and a tape dispenser.

According to an exemplary embodiment, the user may hold the scissors with one hand while the other free hand may be used to pull and cut a swath of tape from the integrated tape dispenser.

Another aspect of this invention is to construct the scissors and a dispenser in such a manner that the unitary construction apparatus can be placed on a plane surface with the scissor blades in an upright position ready for use. That is, at rest, the blades on the scissors are oriented in a ready to cut position that is perpendicular to the surface on which it is located. The bottom surface of the lower scissor handle preferably has a flat footprint incorporated into the lower scissor handle so the scissor tape dispenser may stand upright with the scissor blades perpendicular to the surface the flat foot of the lower scissor handle is resting upon. As such, the scissor tape dispenser may now sit on top of the user's desk, together, as one useful unitary tool.

According to yet another aspect of this invention, the roll on the tape is preferably reusable. When the user finishes a roll of tape, the user may easily remove the used roll out of the dispenser, and install a new roll.

Various types of materials may be dispensed by the scissor tape dispenser, including for example, an adhesive tape, ribbon, and the like. The dispensing material of this invention may be a single contiguous roll cut by a cutting implement integrated therewith or the dispensing material may be pre cut into predetermined usable lengths and consolidated onto the dispensing roll.

A further object of this invention is to adapt the scissor tape dispenser for various different types of cutting blades, including, but not limited to for example, cutting scissors for sports medicine professionals, and designed in such a way that different types of blades may be switched out depending on the cutting application.

Yet another aspect of this invention is to provide a cradle (or storage receptacle) including a storage slot into which the blades of the scissor tape dispenser are received. The cradle may include a tray or storage compartments for receiving various items, such as a plurality of paperclips, a spare roll of tape, a note pad, tacks, a pen, and/or any other suitable material.

These and other objects, features, and/or advantages may accrue from various aspects of embodiments of the present invention, as described in more detail below.

BRIEF DESCRIPTION OF THE DRAWINGS

Various exemplary embodiments of this invention will be described in detail, wherein like reference numerals refer to identical or similar components or steps, with reference to the following figures.

DETAILED DESCRIPTION OF EXEMPLARY EMBODIMENTS

Particular embodiments of the present invention will now be described in greater detail with reference to the figures.

The present invention remedies the problems associated with current scissor and tape dispenser devices in several ways. First, the scissors and tape dispenser are integrated into one unit. Therefore, when one locates the scissors, the tape dispenser is also located, and vice versa. The functionality of neither the scissors nor tape dispenser is compromised by the integration of the scissor and tape dispenser as a single integral unit.

This invention also eliminates the problem of putting the scissors down in order to pick up a tape dispenser, and vice versa. Simultaneously, the tape dispenser can be used to dispense tape while holding the scissors and without having to put the scissors down. This is accomplished because while one hand holds the scissors, the other is free hand can pull and cut tape from a tape dispenser incorporated into the scissors.

In operation, the actual taping action can be performed by using the thumb used to grasp the scissors and the "free" hand; thereby allowing one hand to cut and the other hand to tape without monotonously picking up and putting the scissors down. This invention allows the user to be more efficient, save time, and prevent the user from having to constantly switch between picking up and putting down a pair of scissors and a tape dispenser.

According to an exemplary embodiment, the scissor tape dispenser may now be used as a "stand alone" object. The construction of the scissor tape dispenser of this invention can be stored in plain sight and ready for use; similar to an office type stand-alone tape dispenser because the bottom of the lower scissor handle preferably has a flat foot incorporated into the scissor tape dispenser to allow the scissor tape dispenser to stand upright with the scissor blades parallel to the surface it is resting upon. The scissors and tape may now sit on top of the user's desk, together, as one useful tool.

In addition, the tape roll preferably is reusable. When the user finishes a roll of tape, the user simply pulls the used roll out of the dispenser, and installs a new roll. This eliminates the throw-away disposable tape dispenser, and saves the consumer money because now the user only needs to buy new rolls. Thus, less waste is produced and, at the same time, money is saved. With reference to the drawings and in more detail, the scissor tape dispenser will now be described.

Figure 1:
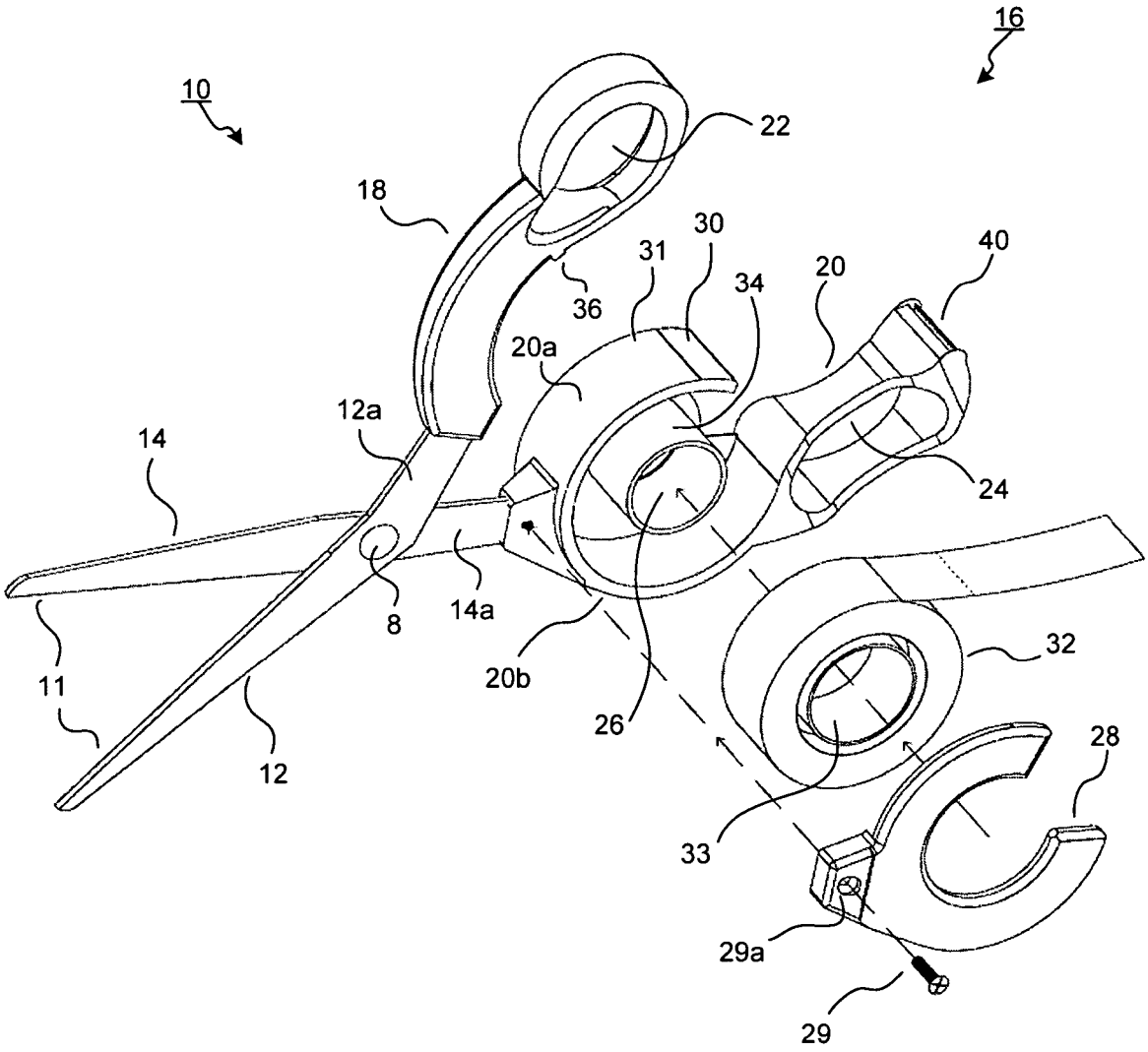
FIG. 1 illustrates an exploded isometric view of the combination scissor tape dispenser apparatus in accordance with this invention.

FIG. 1 illustrates an exploded isometric view of a combination scissor tape dispenser 10 in accordance with an exemplary embodiment. The scissor tape dispenser 10 includes a pair of blades 11 defined as a first elongated cutting member 12 and a second elongated cutting member 14. As illustrated in FIGS. 1-4, the scissor blades 11 may be standard scissor blades. Preferably, the angle of blades 11 is unchanged from the blade 11 to handle.

The scissor handle 16 of the invention has been re-configured to accommodate a tape dispenser portion 30 as will be described in more detail below. In particular, the scissor handle 16 includes two handle portions 18 and 20. The first handle portion 18 is rigidly connected to the first elongated cutting member 12. The second handle portion 20 is rigidly connected to the second elongated cutting member 14. The first handle portion 18 includes a first looped portion 22. Similarly, the second handle portion 20 includes a second looped portion 24.

The scissor handle 16 may be made from a variety of different materials, including but not limited to, a polymer, a metal, a rubber, and/or any other type of material suitable to be used as a scissor handle. Another aspect of this invention is to modularly construct the scissors so that cutting blades of the scissor tape dispenser can be interchangeable and swapped out for various other types of implements, such as gauze cutting shears, electrical wire cutting and stripping shears, metal cutting shears, and the like.

FIGS. 1-4 depict in various angles, an integrated tape dispenser 30. The tape dispenser 30 includes a tape dispenser housing 31 integrated into the second handle portion 20 of the scissor tape dispenser 10. The first handle portion 18 is shown ergonomically modified in construction to rest on top of the tape dispenser housing 31 on the second handle portion 20 when the blades 11 are closed. The through-hole of the first looped portion 22 in the first handle portion 18 is also shown ergonomically configured to suit the hand of a user. That is, for comfort, the first looped portion 22 (or thumb hole position) is substantially similarly located in position to a traditional pair of scissors.

Figure 3:
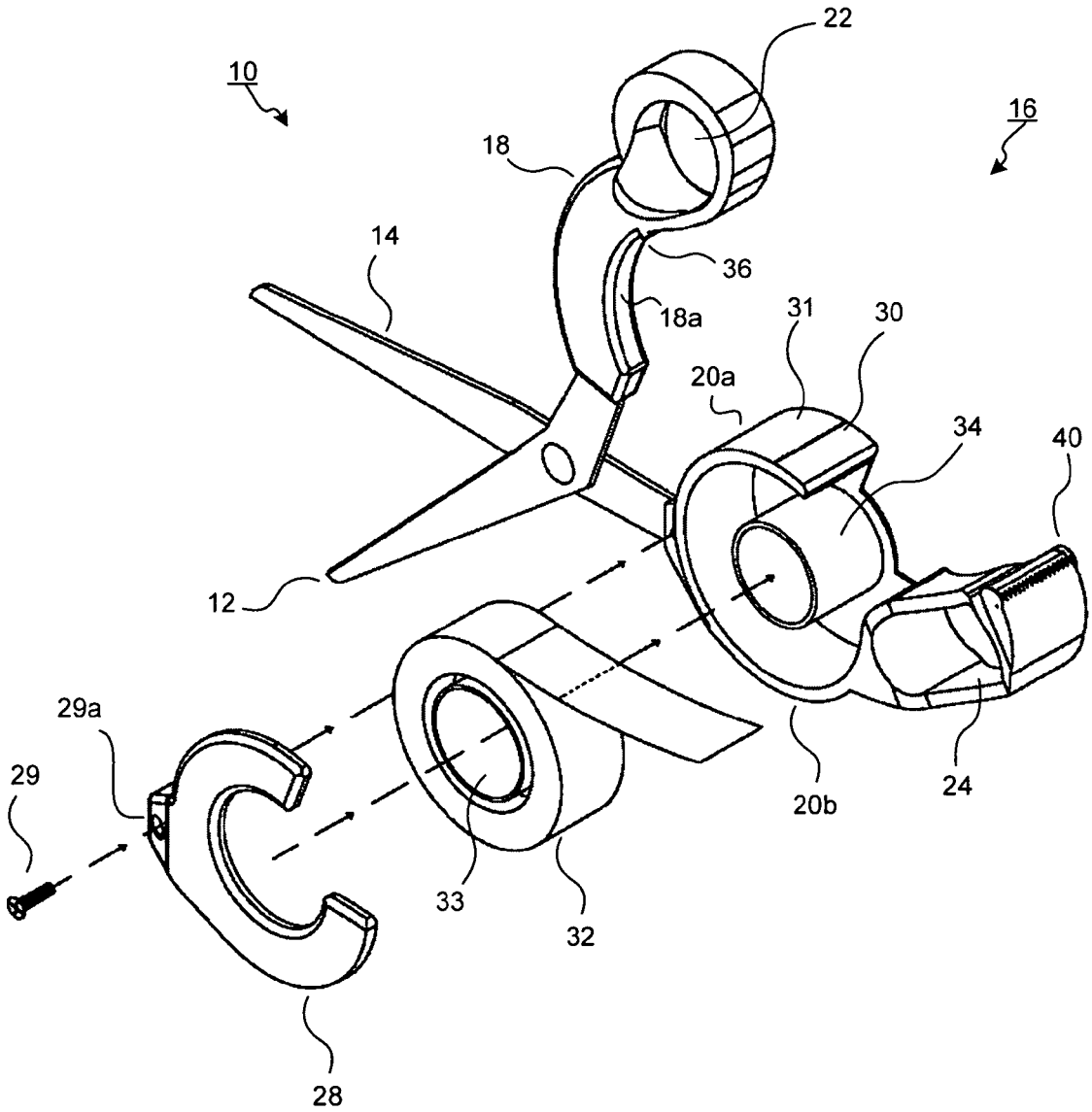
FIG. 3 illustrates another view of the exploded isometric combination scissor tape dispenser apparatus in accordance with this invention.
Figure 4:
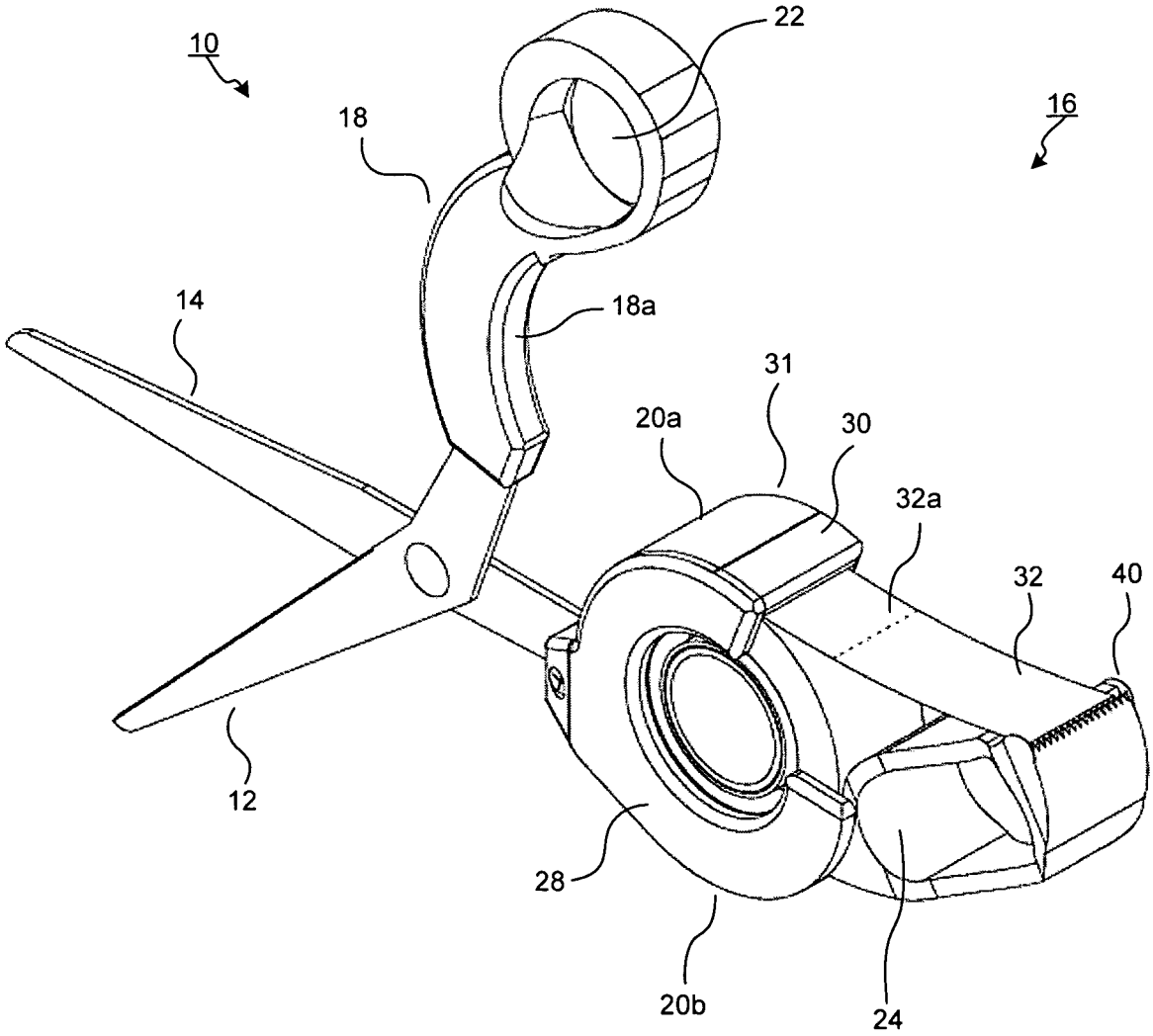
FIG. 4 shows another isometric view of the combination scissor tape dispenser apparatus in accordance with this invention.

As shown in FIGS. 3-4, a bottom surface 18*a* of the first handle portion 18 is contoured to extend over the outer mating top portion 20*a* surface of the tape dispensing housing 31. A stop tab 36 is suitably disposed on the bottom surface 18*a* to abut adjacent to a top portion 20*a* of the tape dispenser housing 31. The stop tab 36 may be designed slightly advanced forward toward the scissor blades 11. The stop tab 36 may take a variety of different configurations depending on the construction of the scissor tape dispenser 10.

Figure 9:
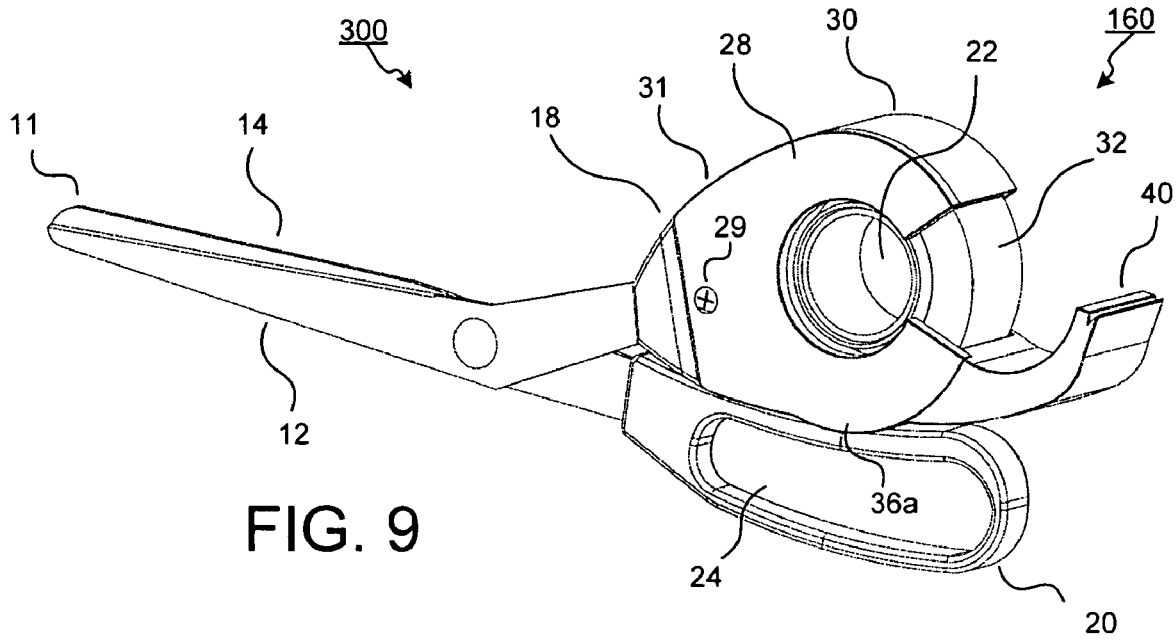
FIG. 9 illustrates an isometric view of a combination scissor tape dispenser including a tape dispenser in an alternative position in accordance with this invention.
Figure 10:
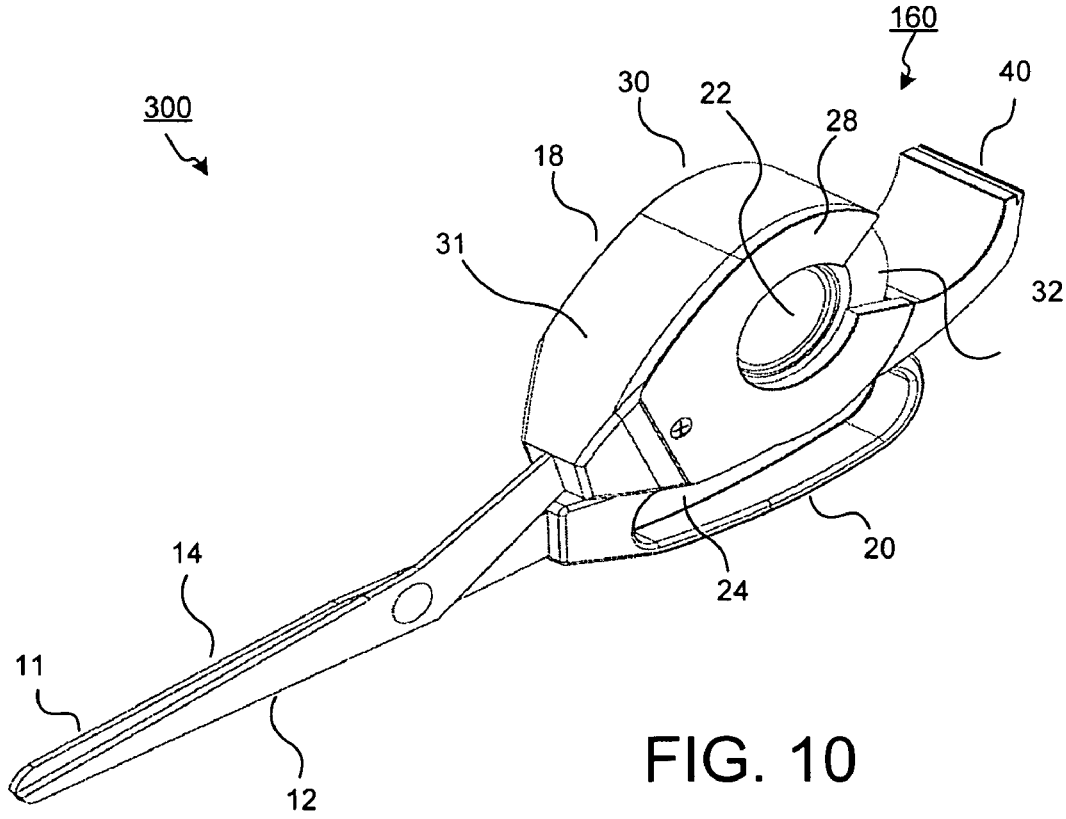
FIG. 10 depicts another isometric angle of the combination scissor tape dispenser including the tape dispenser in the alternative position in accordance with this invention.
Figure 12:
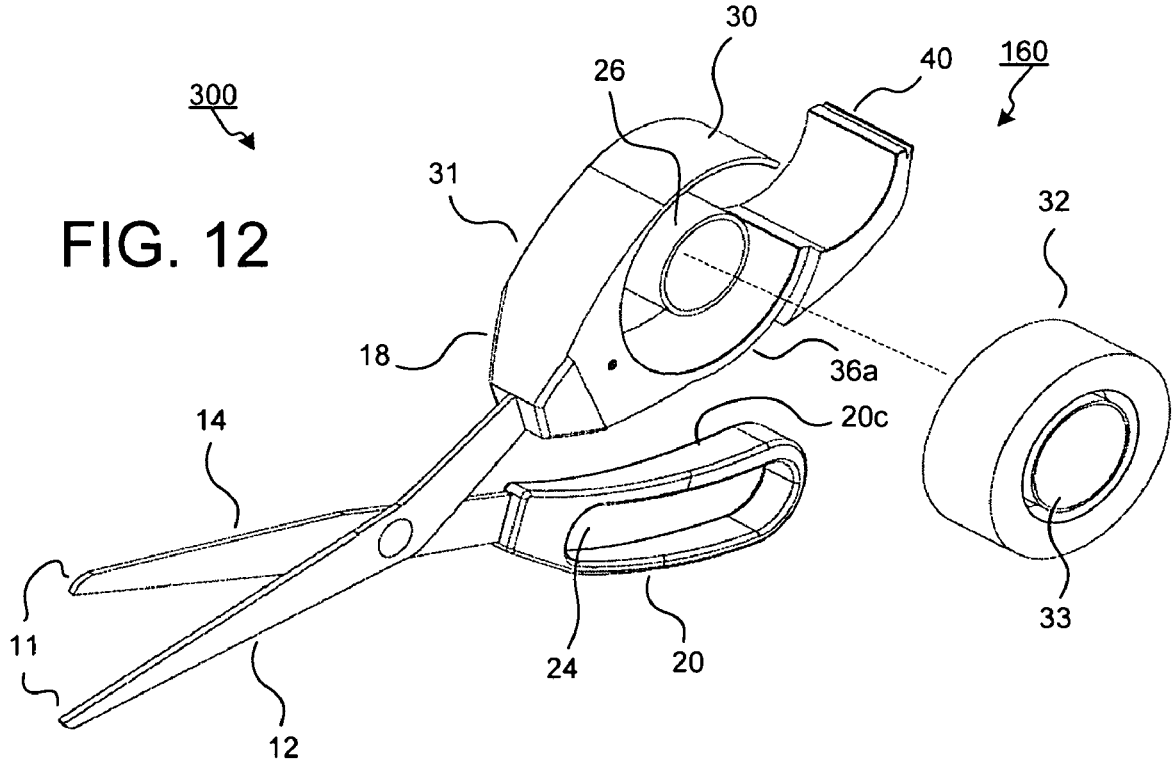
FIG. 12 illustrates an exploded isometric view of the combination scissor tape dispenser including the tape dispenser in an alternative position with the tape removed in accordance with this invention.

By way of example, FIG. 12, shows the stop tab 36*a* being configured as a curved portion in the tape dispenser housing 31. According to this figure, an outermost curved portion is defined by the stop lobed-tab 36*a* that rests against the second handle portion 20 when the scissor tape dispenser 300 is in a closed position as shown in FIGS. 9-10.

According to this invention, the tape dispenser 30 may be integrated on the handle 16 at various locations. As depicted in FIGS. 1-4, the tape dispenser housing 31 is disposed on the second handle portion 20 between the second looped portion 24 and second elongated cutting member 14. A through-hole 26 is disposed central to the tape dispenser housing 31 and may be configured to receive at least one of the user's fingers, such as an index finger. In operation, the user may simultaneously grip the second looped portion 24 and the through-hole 26 with one hand to maintain better control of the scissor tape dispenser 10.

Figure 2:
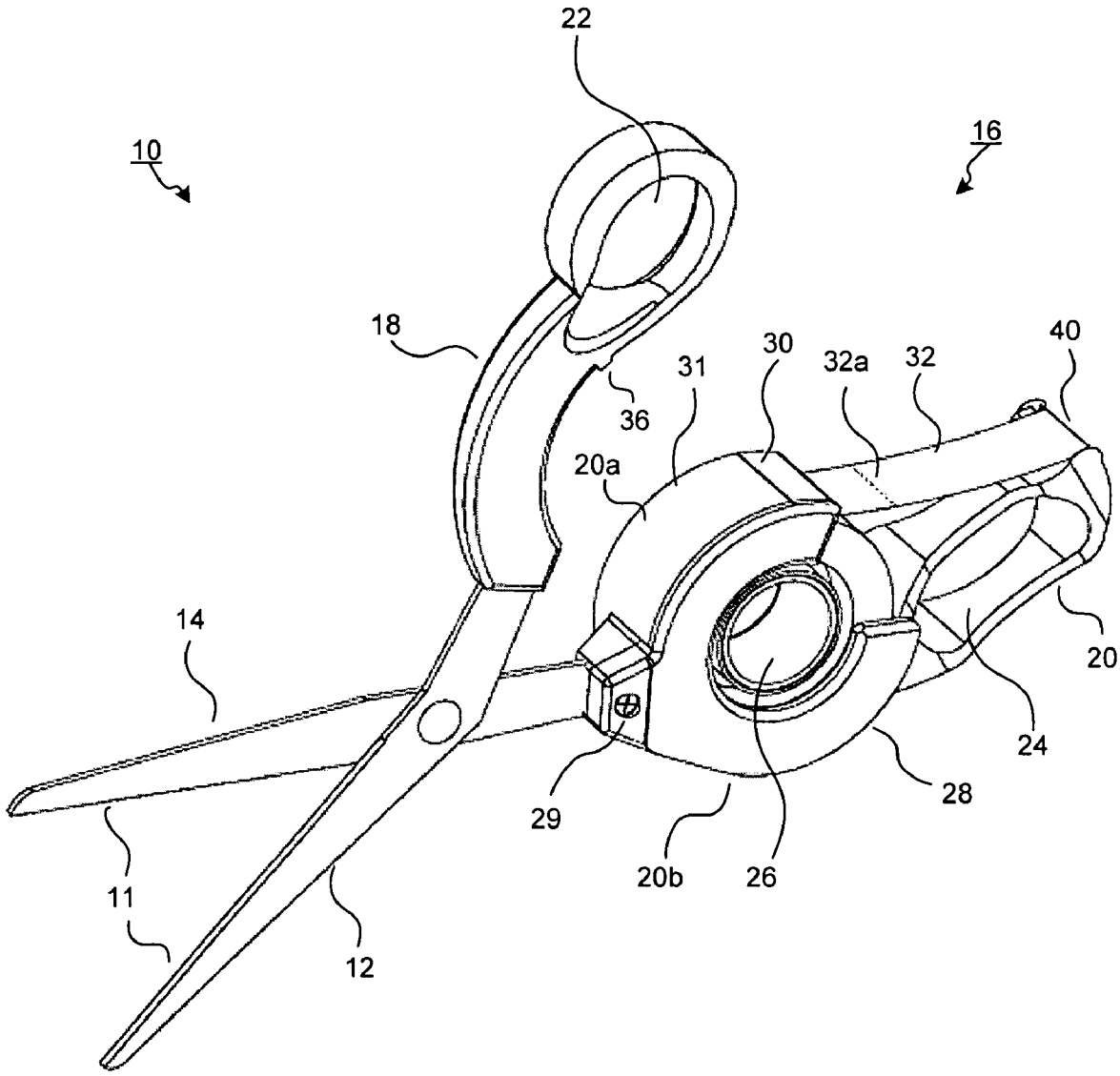
FIG. 2 depicts an isometric view of the combination scissor tape dispenser apparatus in accordance with this invention.

In more detail, the tape dispenser 30 includes a wide flat tape dispenser housing 31 having a central reel 34 defining a central through-hole 26, a cutting implement 40, a tape 32 wrapped around a roll 33 and a removable cover 28. As shown in FIGS. 1 and 3, the cover 28 may be removed to replace the tape 32 recessed within the tape dispenser housing 31 when the tape 32 requires replacement. In assembly, the roll 33 of the tape 32 is centrally disposed around the reel 34 and the cover 28 is secured to the tape dispenser housing 31 with a fastener 29. As shown in FIGS. 2-3, in operation the tape 32 is fed through an opening in the tape dispenser housing 31 toward the cutting implement 40 where a swath can be cut from the tape 32.

The removable cover 28 of the tape dispenser 30 is constructed to enable the reel of tape 32 (and/or other dispensing materials) to be quickly and easily replaced within the tape dispenser housing 31. The removable cover 28 may include a plurality of aligning ridges, seams and/or the like (not shown) which align and secure the removable cover 28 in an operable position over the reel of tape 32 and around the reel 34. In position, a fastener 29 is disposed through an alignment hole 29*a* and secured to the flat tape dispenser housing 31. Although shown as a threaded fastener, the fastener 29 may be any type of suitable fastening mechanism, such as a clip, a latch, a button and the like.

The material being dispensed from the reel of tape 32 may be selected from a variety of adhesives and/or materials. For example, the tape 32 used with the scissor tape dispenser 10 may range in material from an adhesive tape, to a non-adhesive tape, such as gauze, ribbon, a polymer, rubber, twine, a measuring tape, string and/or any other type of material capable of being wound around the reel 34.

According to another aspect of this invention, the material dispensed from the reel of tape 32 may be wrapped onto the roll 33 in a variety of different ways. For example, as shown in FIGS. 2 and 4, the tape 32 may be pre cut into predetermined usable swath lengths 32*a* (as shown in perforated hidden lines) and consolidated onto the roll 33 at the time of manufacture. According to this exemplary embodiment, the pre cut material being dispensed does not have to be cut into lengths by the cutting implement 40.

Figure 5:
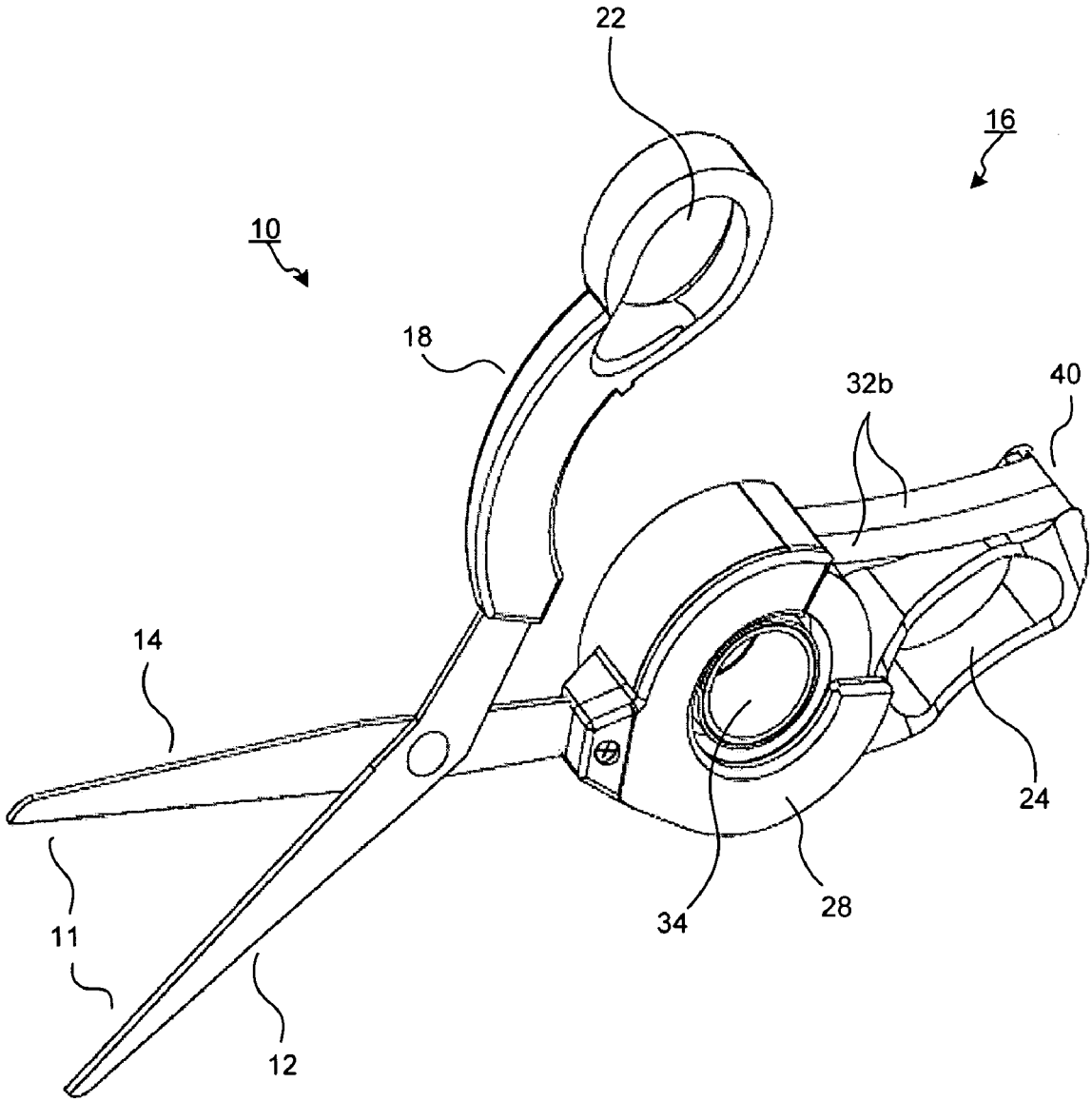
FIG. 5 depicts an isometric view of the combination scissor tape dispenser apparatus including a dual material dispenser in accordance with this invention.

FIG. 5 illustrates another aspect of this invention in which multiple tape rolls 32*b* of a material may be dispensed from the tape dispenser housing 31. That is, the tape dispenser by the scissor tape dispenser 10 may accept multiple rolls of material about the reel 34. As shown, the scissor tape dispenser 10 includes a multiple tape rolls 32*b* wrapped around the tape dispensing reel 34. Each of the individual tape portions of the multiple tape rolls 32*b* may be dispensed simultaneously or individually as desired.

Referring back to FIGS. 1-4, the lower portion of the second handle portion 20 that rests on for example, a desk surface, may be constructed with a wide flat lower scissor handle base 20*b*. The advantage of this construction is that the scissor tape dispenser 10 may sit at rest on a surface in an upward position in which the flat sides of the blades 11 stand vertically upright perpendicular to the surface on which the scissor tape dispenser 10 is placed. The benefit of this construction is that the scissor tape dispenser 10 is positioned upright and in a ready to cut position. The bottom of the lower scissor handle preferably has a flat footprint incorporated into the scissor tape dispenser 10. As such, the scissor tape dispenser 10 may sit ready for use on top of the user's desk, as a single useful unitary tool.

As shown in FIGS. 1-5, the cutting implement 40 is provided at the peripheral end of the handle portion (second handle portion 20) including the tape dispenser housing 31 to cut a swath of tape from the reel of tape 32 (or tapes 32*a*). The cutting implement 40 includes a plurality of sharp serrated edges used for cutting a swath of tape 32 from the tape dispenser 30. It is to be understood that various types of cutting implements may be employed in accordance with this invention which are now know or later discovered.

Furthermore, it is an object of this invention to provide a safety guard (not shown) to cover the cutting implement 40. For example, the cutting implement 40 may be designed similar to a conventional packing tape dispenser gun which may include an "automatic tape cutter." In use, the cutting implement is concealed until a pressure is applied to cutting implement 40 which in response a cutting implement automatically cuts the tape 32.

The scissor tape dispenser 10 is adapted to work in conjunction with a variety of different types of scissor style implements, such as for example, cutting shears used in the medical field, cutting shears by sports medicine professionals, electrical wire strippers in which an electrical tape may be integrated, metal cutting shears, and the like. In more detail, the blades of the electrical wire cutting and stripping shears may include a section for stripping various gauge wires and a section for cutting the wire as conventionally implemented in typical electrical wire cutting and stripping shears. Likewise, the blades of the electrical wire cutting and stripping shears may be interchanged into the scissor tape dispenser of this invention. In the alternative, the handle and the electrical wire cutting and stripping blades may be constructed as a unitary structure including a dispenser for electrical tape, or the like.

Figure 6:
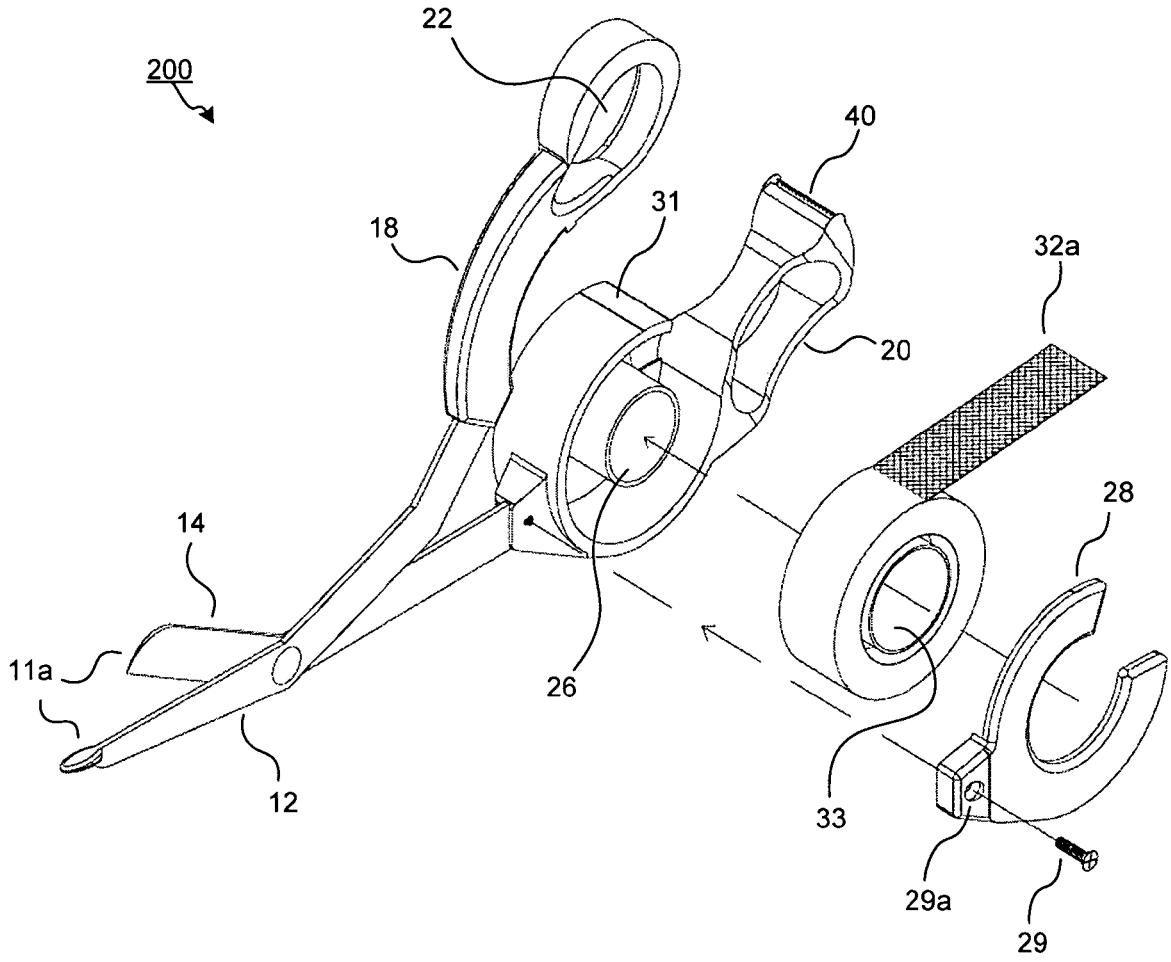
FIG. 6 illustrates an exploded isometric view of another combination scissor tape dispenser including an alternative blade in accordance with this invention.
Figure 7:
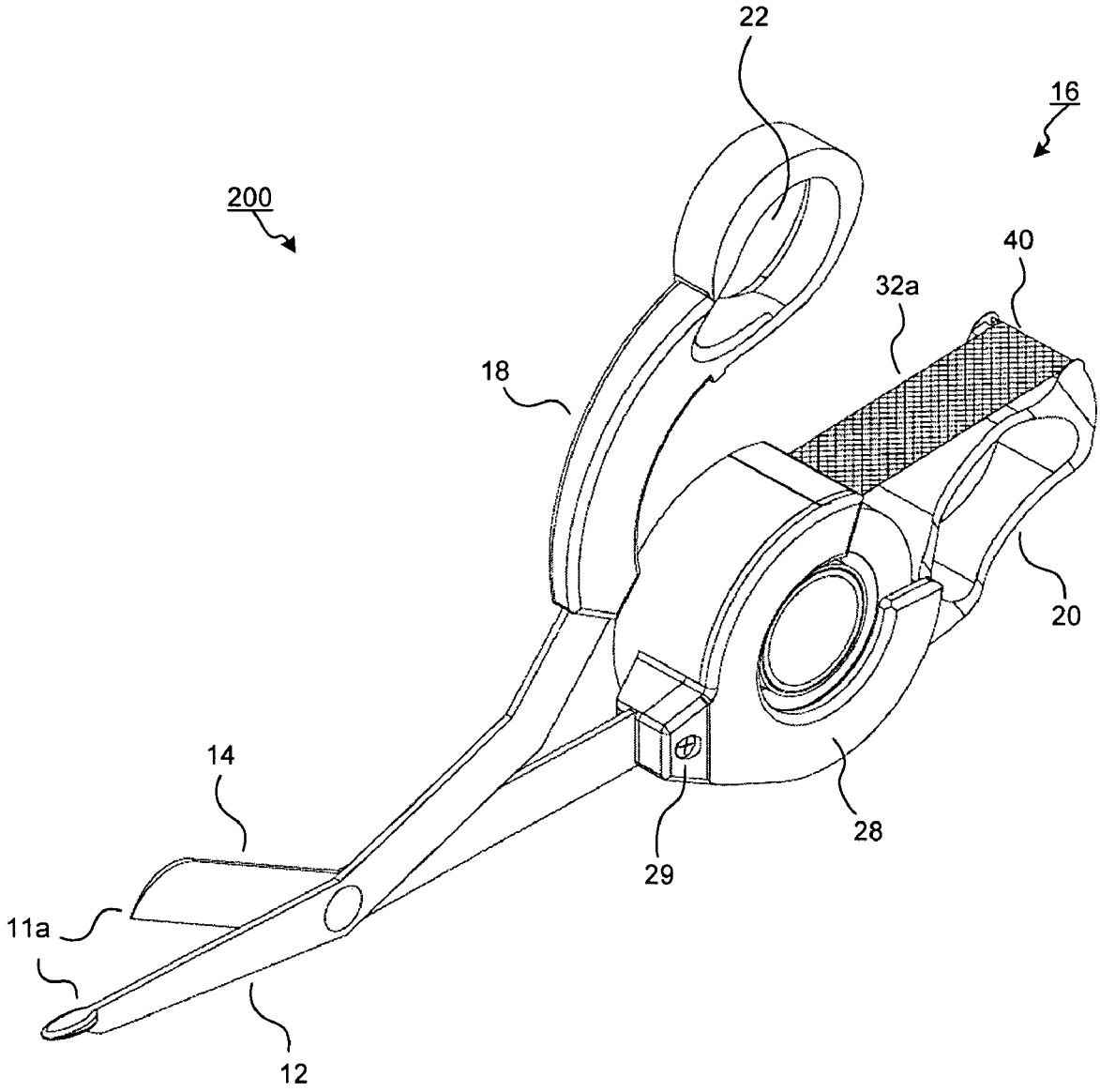
FIG. 7 shows an isometric view of the combination scissor tape dispenser including the alternative blade in accordance with this invention.
Figure 8:
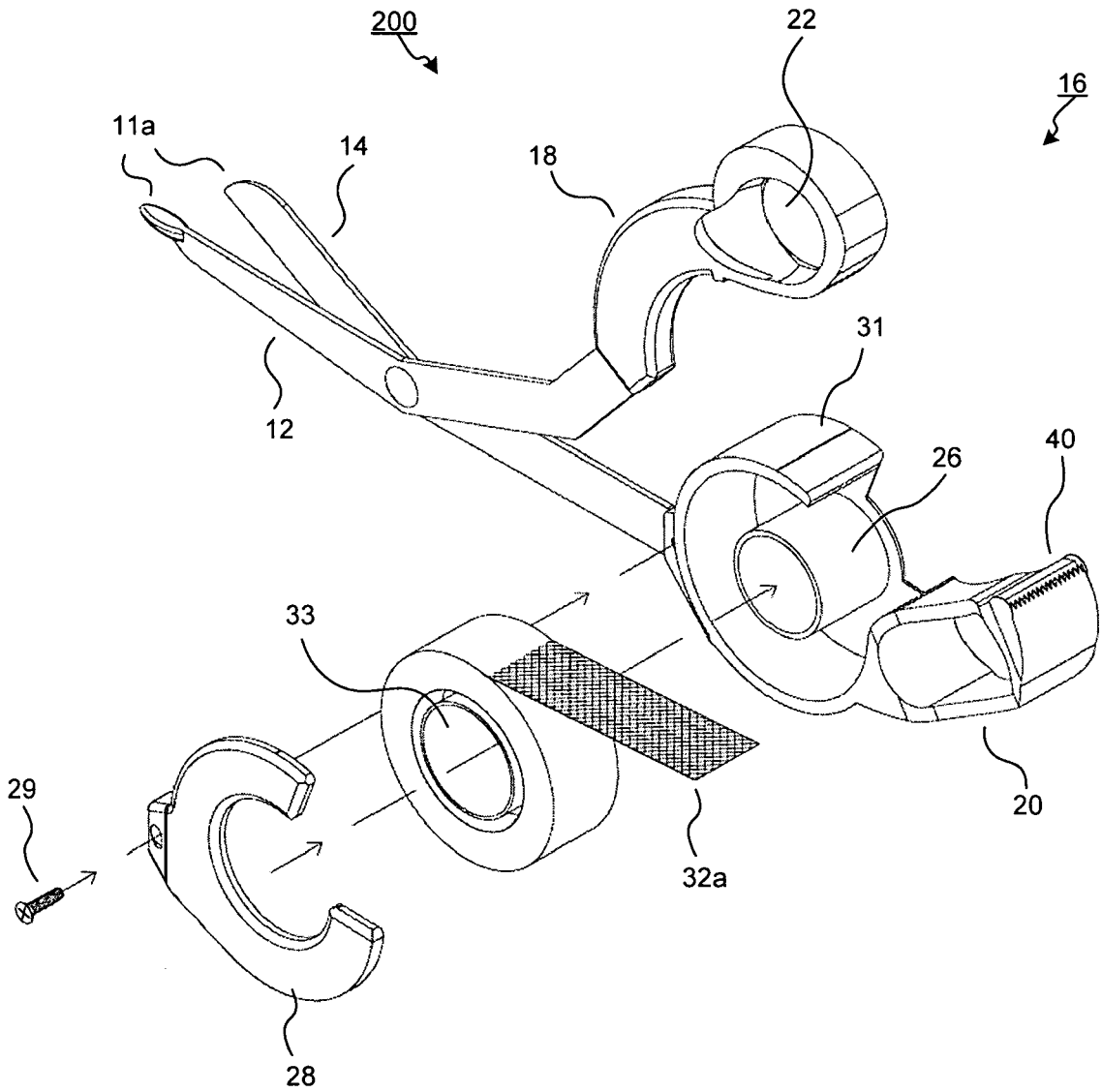
FIG. 8 illustrates a different view of the exploded isometric view of the combination scissor tape dispenser including the alternative blade in accordance with this invention.

FIGS. 6-8 illustrate isometric views of a medical scissor tape dispenser 200 depicting an alternative set of blades (including a blunt nose on the first elongated cutting member 12) used for example in medical and sports medicine applications. FIG. 6 illustrates the versatility of this invention being applicable to a variety of cutting implements. It is to be understood that the medical scissor tape dispenser 200 shown in FIGS. 6-8 include the features and functionality of the scissor tape dispenser 10 discussed above with respect to FIGS. 1-5. The medical scissor tape dispenser 200 illustrates a modified set of blades 11*a*. Likewise, an alternative material tape 32*a* (such as an athletic tape, gauze, or the like) is wrapped around the roll 33 that is to be dispensed in according to this embodiment.

In FIGS. 1-8, the reel of tape 32, 32*a* is shown housed in a tape dispenser housing 31 located on the lower handle portion 20 between the second elongated cutting member 14 and the second looped portion 24. However, it is also to be understood that the placement of the tape dispenser 30 integrated onto the scissor tape dispenser is versatile and may be located at any position. For example, the tape dispenser 30 may be integrated into the handle, or onto the blades 11, 11*a* of the scissor tape dispenser.

Figure 11:
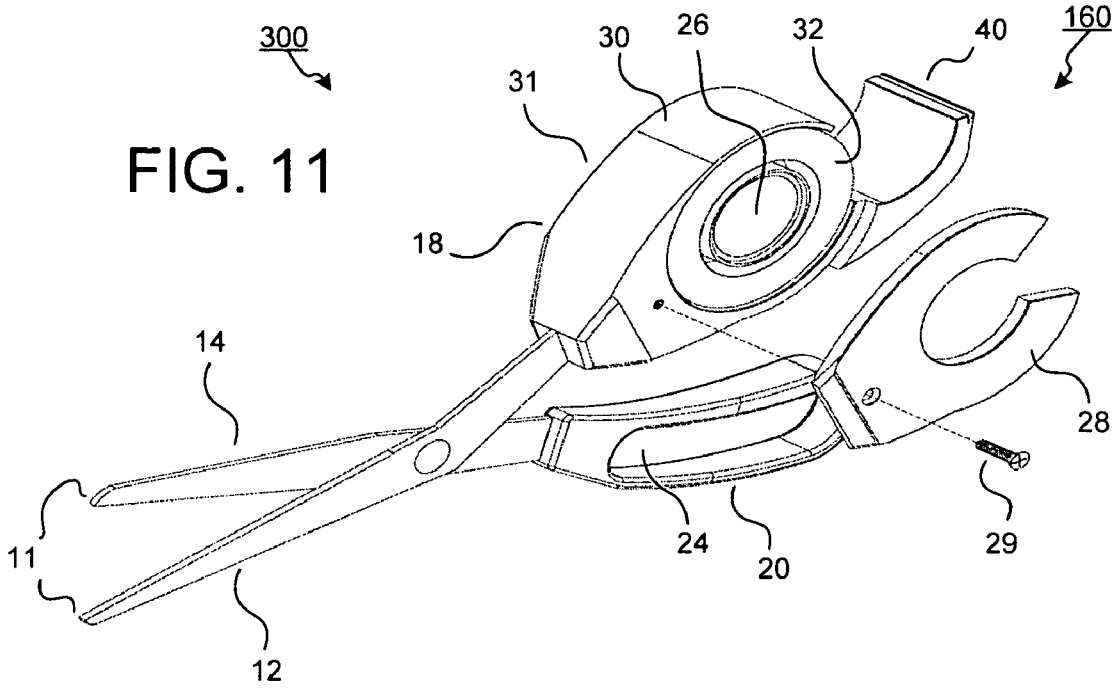
FIG. 11 illustrates an exploded isometric view of the combination scissor tape dispenser including the tape dispenser in an alternative position with the cover removed in accordance with this invention.

FIGS. 9-12 illustrate the tape dispenser housing 31 of the tape dispenser 30 being constructed as part of the upper handle portion 18 of the modified handle 160. According to this exemplary embodiment, the tape dispenser housing 31 is constructed around the first 22 looped portion on the upper handle portion 18. It is further understood that the scissor tape dispenser 300 shown in FIGS. 9-12 includes the features and functionality of the scissor tape dispensers 10, 200 discussed above with respect to FIGS. 1-8. FIGS. 11 and 12 illustrate the removal of the cover 28 and reel of tape 32 of the scissor tape dispenser 300.

FIGS. 13-16 depict a cradle 50 (or storage receptacle) capable of being used in accordance with this invention. As shown in FIGS. 13-16, the blades 11 of the scissor tape dispenser 10 are received in a front-entry slot 52. The front-entry slot 52 is configured to receive the blade of the scissor tape dispenser 10.

Figure 13:
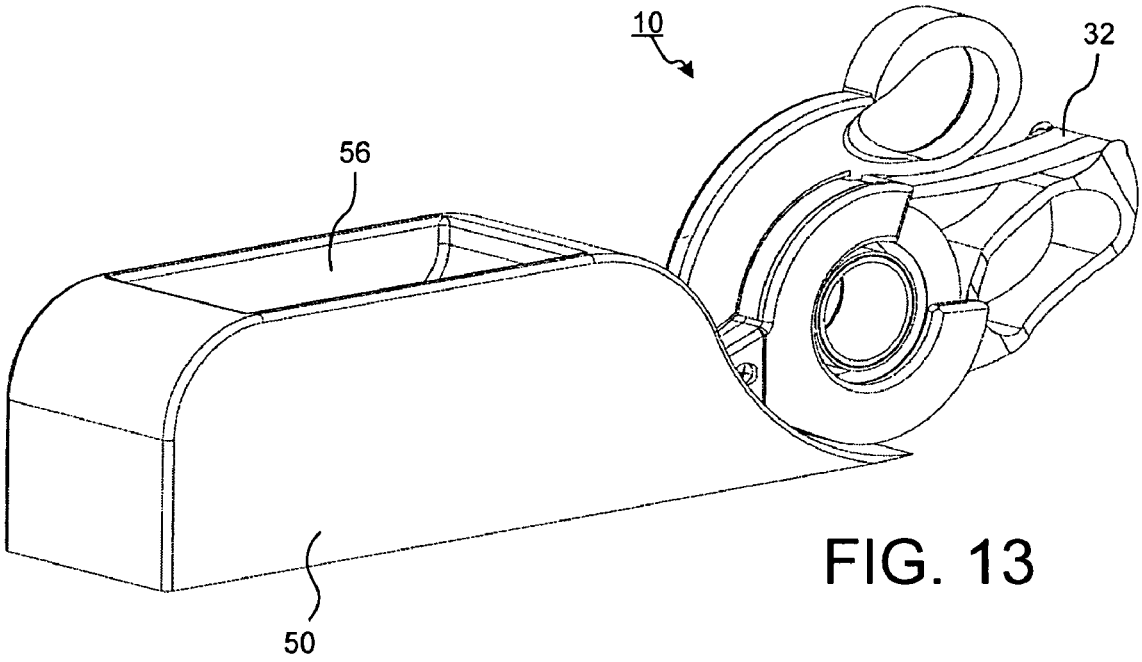
FIG. 13 illustrates an isometric view of the combination scissor tape dispenser disposed within a cradle in accordance with this invention.
Figure 14:
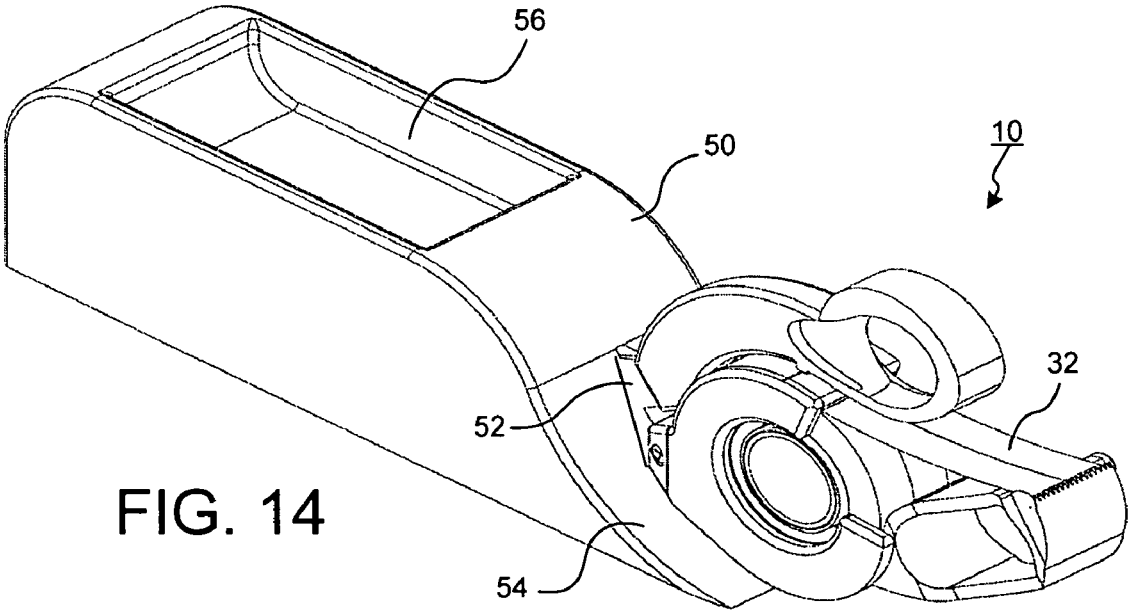
FIG. 14 illustrates another isometric view from a different angle of the combination scissor tape dispenser disposed within the cradle in accordance with this invention.
Figure 15:
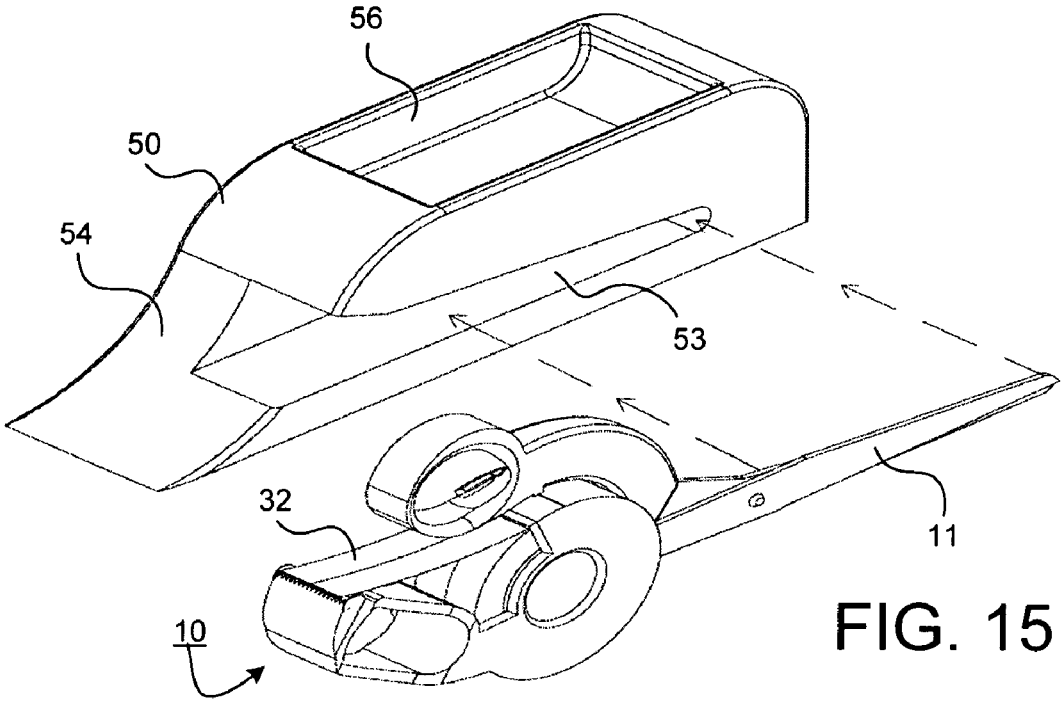
FIG. 15 illustrates an exploded isometric view of the combination scissor tape dispenser removed from the cradle in accordance with this invention.
Figure 16:
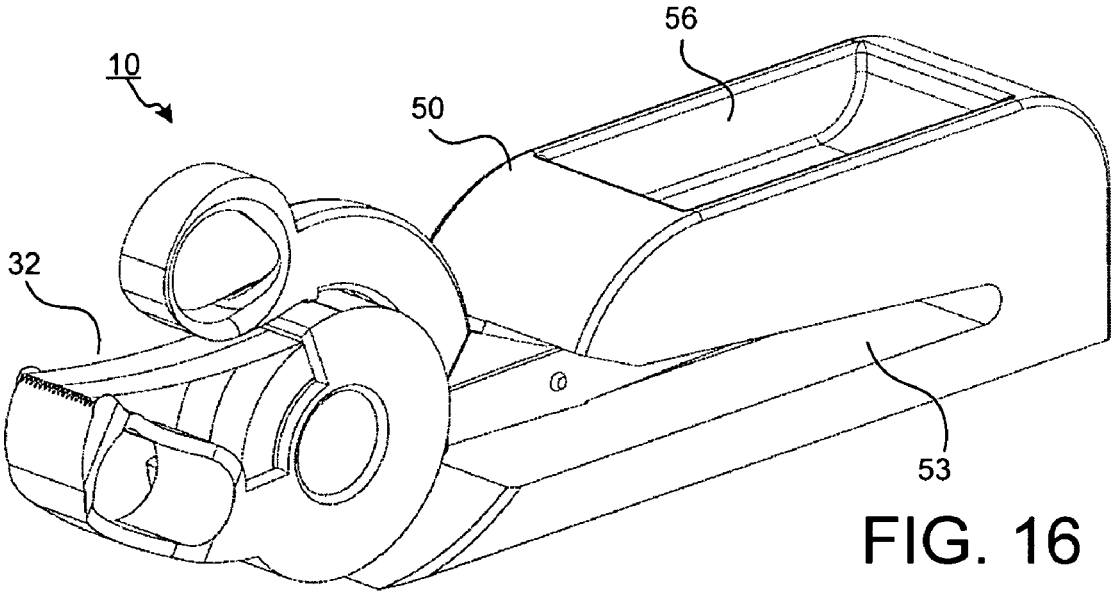
FIG. 16 illustrates an isometric view of the combination scissor tape dispenser disposed within the cradle in accordance with this invention.

FIGS. 15 and 16 depict the blades 11 of the scissor tape dispenser 10 being slid into the side-open slot 53 from an open side of the cradle 50. However, the side-open slot 53 may be constructed as a front-entry slot 52 as shown in FIGS. 13-14 into which the cradle 50 directly receives the blades 11 inserted into the front-entry slot 52 in the forward side 54 of the cradle 50. As shown in the storage position in FIGS. 13-14 and 16, the cradle 50 may be designed to allow the tape 32 to be dispensed while the scissor tape dispenser 10 remains firmly secured to the cradle 50.

The cradle 50 may be constructed in variety of different ways and may be adapted for a plurality of uses. FIGS. 13-16 illustrate the cradle 50 including a tray 56 for receiving various items, such as a plurality of paperclips, and the like. Other uses the cradle can provide may include, for example, holding a spare tape 32, holding a pen and note pad, and/or any other suitable material and/or function aligned with using scissors, a tape dispenser and/or other office equipment.

It will be recognized by those skilled in the art that changes or modifications may be made to the above described embodiment without departing from the broad inventive concepts of the invention. It is understood therefore that the invention is not limited to the particular embodiment which is described, but is intended to cover all modifications and changes within the scope and spirit of the invention.

What is claimed is:

1. A scissors comprising a first member and a second member;

the first member including a first elongate cutting member and a first handle portion, the first handle portion having only one through hole adapted to receive at least one finger, the through hole defining a center axis, wherein the first handle portion defines a housing, a reel defining the through hole, and a projecting part extending from the housing away from the reel, the projecting part including a cutting implement extending substantially parallel to the center axis;

the second member pivotally connected to the first member, the second member including a second elongate cutting member and a through hole portion.

2. The scissors recited in claim 1, further comprising a roll of tape, wherein the roll of tape is supported by the reel.

3. The scissors recited in claim 2, wherein, when the tape is dispensed, the tape travels from the reel to the cutting implement to cut the tape.

4. The scissors recited in claim 2, wherein the tape is selected from at least one of an adhesive tape, an athletic tape, a surgical tape, an electrical tape, and a ribbon.

5. The scissors recited in claim 2, wherein the tape is a multiple tape that includes more than one material.

6. The scissors recited in claim 1, wherein the through hole portion of the second member has a wide base that allows elongate sides of the first and second elongate cutting members to rest upright.

7. The scissors recited in claim 1, wherein the housing includes a removable cover for replacing the tape being dispensed.

8. A scissors comprising a first member and a second member;

the first member including a first elongate cutting member and a first handle portion, the first handle portion having only one through hole adapted to receive at least one finger, the through hole defining a center axis;

the second member pivotally connected to the first member, the second member including a second elongate cutting member and a second handle portion, the second handle portion having only one through hole adapted to receive at least one finger, the second through hole defining a center axis;

wherein one of the handle portions defines a housing, a reel defining a respective one of the through holes, and a projecting part extending from the housing away from the reel, the projecting part including a cutting implement extending substantially parallel to a respective one of the center axes.

9. The scissors recited in claim 8, further comprising a roll of tape, wherein the roll of tape is supported by the reel, and, when the tape is dispensed, the tape travels from the reel to the cutting implement to cut the tape.

10. The scissors recited in claim 9, wherein the tape is a multiple tape that includes more than one material.

11. The scissors recited in claim 8, wherein the housing and the other handle portion include a flat portion to allow elongate sides of the elongate cutting members to rest upright.

12. The scissors recited in claim 8, wherein the housing includes a removable cover for replacing a tape being dispensed.

13. A scissors comprising a first structure and a second structure;

the first structure including a first elongate cutting member and a first handle portion, the first handle portion having only one through hole adapted to receive at least one finger, the through hole defining a center axis, wherein the first handle portion defines a housing, a reel defining the through hole, and a projecting part extending from the housing away from the reel, the projecting part including a cutting implement extending substantially parallel to the center axis; and the second member pivotally connected to the first member, the second member including a second elongate cutting member and at least one through hole portion.

14. The scissors recited in claim 13, further comprising a roll of tape, the roll of tape, wherein is supported by the reel, and, when the tape is dispensed, the tape travels from the reel to the cutting implement to cut the tape.

* * * * *